United States Patent [19]

Sasaki et al.

[11] Patent Number: 5,069,556

[45] Date of Patent: Dec. 3, 1991

[54] METHOD FOR CORRECTING DRIFT OF PRINTING POSITION AND PRINTING APPARATUS FOR PRACTISING THE SAME

[75] Inventors: Hideki Sasaki; Shinji Matsuoka, both of Hitachi; Akihiko Yamamoto, Toukai, all of Japan

[73] Assignee: Hitachi, Ltd., Tokyo, Japan

[21] Appl. No.: 494,540

[22] Filed: Mar. 16, 1990

[30] Foreign Application Priority Data

Mar. 17, 1989 [JP] Japan ..... 1-63750

[51] Int. Cl.[5] ..... B41J 3/42

[52] U.S. Cl. ..... 400/74; 400/279; 400/322; 395/105

[58] Field of Search ..... 400/6, 60, 67, 63, 70, 400/74, 76, 279, 280, 282, 320, 322; 364/519

[56] References Cited

U.S. PATENT DOCUMENTS

| | | | |
|---|---|---|---|
| 4,020,939 | 3/1977 | Quaif et al. | 400/279 |
| 4,434,419 | 2/1984 | Couper et al. | 400/83 |
| 4,493,570 | 1/1985 | Araki | 400/279 |
| 4,575,813 | 3/1986 | Bartlett et al. | 400/279 |
| 4,577,197 | 3/1986 | Crean et al. | 346/75 |
| 4,629,342 | 12/1986 | Futakl | 400/74 |
| 4,801,775 | 8/1989 | Horl et al. | 400/76 |
| 4,804,284 | 2/1989 | Hattori et al. | 400/279 |
| 4,814,892 | 3/1989 | Igarashi | 400/74 |
| 4,875,409 | 10/1989 | London et al. | 400/74 |
| 5,007,751 | 4/1991 | Yamakawa | 400/322 |

*Primary Examiner*—Eugene H. Eickholt

*Attorney, Agent, or Firm*—Antonelli, Terry, Stout & Kraus

[57] ABSTRACT

Both a test printing pattern during a forth direction printing and a test printing pattern during a back direction printing are displayed on a screen of a display apparatus. The test printing pattern is occurred at a predetermined detection position by counting a value of an up/down counter. A printing position drift between the forth direction printing and the back direction printing is shown on the screen. The optimum printing position drift having the smallest printing position drift amount is detected on the screen by the test printing patterns. A corrected result of the printing position drift is printed. A correction value of the printing position drift is renewed at an optimum value. The printing position drift in such as ruled lines is set at the minimum value. A high quality printing for a document data can be maintained and a high throughput for the document data can be obtained.

12 Claims, 12 Drawing Sheets

FIG. 11

```
** WORK MENU **

  1 DOCUMENT NEW PREPARATION
  2 DOCUMENT RENEWAL
          |
          |
  5 SUPPLEMENTARY FUNCTION
  0 FINISH

INPUT MENU NUMBER : __
```

FIG. 12

```
** SUPPLEMENTARY MENU **

  1 DOCUMENT MANAGEMENT
  2 FLOPPY COPY
          |
          |
          |
  9 PRINTING CORRECTION
  0 FINISH

INPUT MENU NUMBER : __
```

FIG. 13

```
** PRINTING CORRECTION MENU **

  1 CORRECTION RENEWAL
  2 SET VALUE PRINTING
  0 FINISH

INPUT MENU NUMBER : __
```

FIG. 14

```
** SELECTION INPUT MENU **

INPUT SELECTION NUMBER OF OPTIMUM
PRINTING RESULT : __
```

METHOD FOR CORRECTING DRIFT OF PRINTING POSITION AND PRINTING APPARATUS FOR PRACTISING THE SAME

BACKGROUND OF THE INVENTION

The present invention relates to a method for correcting a drift of a printing position and a printing apparatus for practicing the same and, more particular to a method for correcting a drift of a printing position and a printing apparatus for practicing the same such as a wire dot printer and an ink jet recording apparatus in which a drift of a printing position is corrected in a forth and back direction printing or a forth passage printing and a back passage printing.

In a conventional printing apparatus for printing a document data in which a print head moves in a forth and back direction, a printing position drift generates slightly between a printing pattern of a forth passage printing and a printing pattern of a back passage printing. This printing position drift generates in order that a rotation of a carriage drive motor for moving a carriage does not correspond completely to a movement position of the print head.

Namely, a position detection of the print head is practices in accordance with a rotation amount of the carriage drive motor for moving the carriage in a forth and back direction, however a history characteristic exists slightly in a mechanical drive system drive force transmission, which is inserted between the carriage drive motor and the carriage (print head).

An amount of this printing position drift is about 0.1 mm degree, however in a case of the printing of longitudinal ruled lines extending over a plurality of lines, this printing position drift amount is not a negligible amount. Accordingly, in a case of the printing for the document data including the longitudinal ruled lines, in the conventional printing apparatus the back passage printing is give up and but the forth passage printing carried out repeatedly. As a result, it requires a large printing time for the document data and an actual printing speed or a throughput is lowered.

The printing position drift of the printing pattern in the forth and back direction printing can correct and print with this correction, if a present position of the print head (carriage) were detected accurately.

A conventional printing apparatus is disclosed, for example in Japanese Patent Laid-Open No. 64586/1987, in which for a right end arrangement of the printing pattern in the forth and back direction printing, an optimum acceleration/deceleration speed control table for controlling the carriage drive motor for driving the carriage is selected according to taking a look at an observation of the printing result.

Another conventional method for correcting a drift of a printing position is disclosed, for example in Japanese Patent Laid-Open No. 109657/1987, in which during a forth and back direction printing in an ink jet recording apparatus, for correcting of a printing position drift, a correction method for delay correcting a print timing against a position detection according to taking a look at an observation of the printing result.

However, in the above stated prior arts, in the former prior art, all of the printing position drifts during the printing on the way can not correct, because an acceleration/deceleration speed characteristic for the carriage drive motor is put in order at both ends of the carriage.

Further, in the latter prior art, the printing position drift generates due to a speed fluctuation of the print head (carriage) in a series of the printing, because the correction for the printing position drift is practices by setting a delay time at a proper value.

SUMMARY OF THE INVENTION

An object of the present invention is to provide a method for correcting a drift of a printing position and a printing apparatus for practicing the same wherein a printing position drift of a printing pattern can be corrected.

Another object of the present invention is to provide a method for correcting a drift of a printing position and a printing apparatus for practicing the same wherein a printing position drift of a printing pattern due to a history characteristic in a drive system of a printing apparatus can be corrected.

A further object of the present invention is to provide a method for correcting a drift of a printing position and a printing apparatus for practicing the same wherein a printing position drift of a printing pattern due to a history characteristic in a drive system in a forth and back direction printing can be corrected.

A still object of the present invention is to provide a method for correcting a drift of a printing position and a printing apparatus for practicing the same wherein a correction value of a printing position drift correction can be renewed at an optimum value.

A further still object of the present invention is to provide a method for correcting a drift of a printing position and a printing apparatus for practicing the same wherein a correction value of a printing position drift correction in a forth passage and a back passage at a forth and back direction printing can be renewed at an optimum value.

A still further object of the present invention is to provide a method for correcting a drift of a printing position and a printing apparatus for practicing the same wherein a correction value of a printing position drift correction can be dispensed in accordance with a simple operation.

A still further object of the present invention is to provide a method for correcting a drift of a printing position and a printing apparatus for practicing the same wherein a high quality printing can be maintained.

A still further object of the present invention is to provide a method for correcting a drift of a printing position and a printing apparatus for practicing the same wherein a high speed printing or a high throughput for a document data can be obtained.

In accordance with the present invention, a method for correcting a drift of a printing position in which a print head is moved toward a forth and back direction at a width direction of a printing paper, the printing paper is moved in a lengthwise direction of the printing paper, a movement signal occurs every predetermined amount of a movement of the printhead and is counted, the print head prints a printing pattern by reading the printing pattern in accordance with a predetermined detection position which is indicated by a counting value of the movement signal, an input apparatus prints the printing pattern on the printing paper, and a printing position drift, which is relative to at a width direction during a forth passage printing and a back passage printing in the input apparatus, is corrected.

In a printing with a printing position correction mode; in one of the forth and back movement of the print head, a first test printing pattern control for moving the print head is carried out by occurring a first test printing pattern at a predetermined detection position which is indicated by the counting value; in the other of the forth and back movement of the print head, a second test printing pattern control for moving the print head is carried out by occurring a second test printing pattern at a predetermined detection position which is indicated by the counting value, the second test printing pattern is occurred at a displacement position with an amount of a predetermined movement in a front side or in a rear side with respect to the predetermined detection position; by selecting and inputting a relative test printing pattern, which is printed during a forth and back direction printing and has a minimum printing position drift, a displacement value in a one-way test printing pattern control for printing a selected test printing pattern is detected; and a detection position correction value is obtained and memorized in accordance with the detected displacement value.

In a printing with a document printing mode; in one of the forth and back movement of the print head, a first test printing pattern control for driving the print head is carried out by occurring a first test printing pattern at a predetermined detection position which is indicated by the counting value; in the other of the forth and back movement of the print head, a second test printing pattern control for moving the print head is carried out by occurring a second test printing pattern at a predetermined detection position which is indicated by the counting value, the second test printing pattern is occurred at a displacement position with an amount of a predetermined movement in a front side or in a rear side with respect to the predetermined detection position; by selecting and inputting a relative test printing pattern, which is printed during a forth and back direction printing and has a minimum printing position drift, a displacement value in a one-way test printing pattern control for printing a selected test printing pattern is detected; a detection position correction value is obtained and memorized in accordance with the detected displacement value; and a document pattern is printed by correcting a relative relation between a detection position during the forth passage printing and a detection position during the back printing in accordance with the memorized correction value.

In accordance with the present invention, a method for correcting a drift of a printing position in which a print head is moved toward a forth and back direction at a width direction of a printing paper, the printing paper is moved in a lengthwise direction of the printing paper, the print head prints a printing pattern by reading the printing pattern in accordance with a detection position of the print head, an input apparatus prints the printing pattern on said printing paper, and a printing position drift, which is relative to at a width direction during a forth passage printing and a back passage printing in the input apparatus, is corrected.

In a printing with a printing position drift correction mode; during one printing of the forth passage printing and the back passage printing, a test printing pattern control is carried out at a predetermined print head detection position, during the other printing of the forth passage printing and the back passage printing, a test printing pattern control is carried out at a displacement position with an amount of a predetermined movement against the predetermined print head detection position; by selecting and inputting a relative test printing pattern, which is printed during a forth and back direction printing and has a minimum printing position drift, a displacement value in the test printing pattern control for printing a selected test printing pattern is detected; and a detection position correction value is obtained and memorized in accordance with the detected displacement value.

In a printing with a document drift correction mode a relative relation between a detection position during the forth passage printing and a detection position during the back passage printing is corrected and printed in accordance with the memorized correction value.

In accordance with the present invention, an input apparatus comprises a print head mounted on a carriage, a carriage drive motor for driving the carriage toward a forth and back movement in a width direction of a printing paper, a home position detection means for detecting a home position of the print head, the home position for the print head is a standard position of a movement in the width direction of the print head, a print head position detection means for detecting a position with the home position of the print head, a printing pattern memory means for memorizing a printing pattern, the printing pattern is printed using the print head, a print head drive means for controlling a printing of the print head by reading out the printing pattern from the printing pattern memory means in accordance with a position of the print head, the position of the print head is detected from the print head position detection means, a printing paper feed means for feeding the printing paper toward a lengthwise direction of the printing paper, and after a position is corrected with a predetermined amount against a position detection result of the print head, a printing position drift correction control means carries out the printing using the print head.

The print head position detection means includes a forth passage position detection means for detecting a present position of the print head in accordance with a counting value by addition-counting successively an electric signal generated every unit movement amount during a forth passage movement of the print head, and a back passage position detection means for detecting a present position of the print head in accordance with a counting value by subtraction-counting successively the electric signal generated every unit movement amount during a back passage movement of the print head; the printing position drift correction means, in a printing with a printing position drift correction mode, includes a first test printing pattern control means for moving the print head by generating a test printing pattern at a predetermined detection position indicated by the counting value in one of the forth movement and the back movement of the print head, a second test printing pattern control means for moving the print head by generating a test printing pattern to be printed at the predetermined detection position at a position displaced toward a front side or a rear side with a predetermined unit movement amount against the detection position in the other of the forth movement and the back movement of the print head, a printing result selection input means for selecting and inputting a test printing pattern which has a relation of a minimum printing position drift within a relative test printing pattern, the relative test printing pattern is printed by a forth and back direction printing, a printing displacement value detection means for detecting a displacement value of a test printing pattern control in which the selected and inputted test printing pattern is printed, and a printing correction memory means for memorizing a correction value which is obtained under a displacement value detected by the printing displacement value detection means.

In accordance with the present invention, an input apparatus in which a print head is moved toward a forth and back movement in a width direction of a printing paper, the printing paper is moved in a lengthwise direction of the printing paper, the print head is moved in accordance with a detection position of the print head, a printing pattern is printed on the printing paper, and a relative printing position drift at a forth passage printing and a back passage printing in a width direction is corrected.

The input apparatus includes further a test printing pattern control means for controlling a test printing pattern, during one of a forth passage printing and a back passage printing, the test printing pattern control means carries out the test printing pattern control at a predetermined detection position of the print head, and other of the forth passage printing and the back passage printing, the test printing pattern control means carries out the test printing pattern control at a displaced position in a front side or a rear side with a predetermined movement amount against the predetermined detection position; a displacement value detection means for detection a displacement value of a test printing pattern control, the displacement value detection means carries out the test printing pattern control in which a selected test printing pattern drift which has a relation of the minimum printing position drift among relative test printing patterns in a forth and back direction printing; a correction value memory means for memorizing a detection position correction value which is obtained in accordance with the detected displacement value; and a printing position correction means for correcting and printing a relative relation of a detection position in the forth passage printing and a detection position in the back passage printing in accordance with the memorized correction value.

In accordance with the present invention, an input apparatus comprises an input means for inputting a character information and a control indication etc., a display means for displaying the character information and the control indication inputted by the input means, a memory means for memorizing the character information and the control indication inputted by the input means, and a document edition means for carrying out a document edition processing in accordance with the character information and the control indication inputted by the input means and for displaying an edited document in the display means; a print head mounted on a carriage, a carriage drive motor for driving the carriage toward a forth and back movement in a width direction of a printing paper, a home position detection means for detecting a home position of the print head, the home position for the print head is a standard position of a movement in the width direction of the print head, a print head position detection means for detecting a position with the home position of the print head, a printing pattern memory means for memorizing a printing pattern, the printing pattern is printed using the print head, a print head drive means for controlling a printing of the print head by reading out the printing pattern from the printing pattern memory means in accordance with a position of the print head, the position of the print head is detected from the print head position detection means, a printing paper feed means for feeding the printing paper toward a lengthwise direction of the printing paper, and after a position is corrected with a predetermined amount against a position detection result of the print head, a printing position drift correction control means carries out the printing using the print head.

The print head position detection means includes a forth passage position detection means for detecting a present position of the print head in accordance with a counting value by addition-counting successively an electric signal generated every unit movement amount during a forth passage movement of the print head, and a back passage position detection means for detecting a present position of the print head in accordance with a counting value by subtraction-counting successively the electric signal generated every unit movement amount during a back passage movement of the print head; the printing position drift correction means, in a printing with a printing position drift correction mode, includes a first one-way test printing pattern control means for moving the print head by generating a test printing pattern at a predetermined detection position indicated by the counting value in one of the forth movement and the back movement of the print head, a second one-way test printing pattern control means for moving the print head by generating a test printing pattern to be printed at the predetermined detection position at a position displaced toward a front side or a rear side with a predetermined unit movement amount against the detection position in the other hand of the forth movement and the back movement of the print head, a printing result selection input means for selecting and inputting a test printing pattern which has a relation of a minimum printing position drift within a relative test printing pattern by the input means, the relative test printing pattern is printed by a forth and back direction printing, a printing displacement value detection means for detecting a displacement value of a test printing pattern control in which the selected and inputted test printing pattern by the printing result selection input means is printed, and a printing correction memory means for memorizing a correction value which is obtained in accordance with a displacement value detected by the printing displacement value detection means.

In the test pattern printing at the forth and back direction printing during the printing using the printing position drift correction mode, the present position of the print head with respect to the position in the width direction of the printing paper is detected in accordance with the value which is obtained by the addition/subtraction counting the movement signal every predetermined unit movement of the print head.

In the above stated test pattern printing at the forth and back direction printing during the printing using the printing position drift correction mode, one of the test pattern printing is printed at the position by detection, and other of the test printing pattern is printed at the position in which an amount of the predetermined unit movement is displaced in the front side or in the rear side with respect to the present position by detection.

In the printing using the document printing mode, the displacement value is detected by selecting and inputting the minimum printing position drift in accordance with the comparison and the observation of the printing position of the test printing pattern in the forth passage and in the back passage.

In the above stated printing using the document printing mode, the relative printing position drift in the forth and back direction printing is corrected by the basis that the printing position is corrected by the correction value which is obtained under the base of the displacement value corresponding to the above stated selected and inputted printing result.

According to the present invention, the printing position drift correction in the forth passage and the back passage during the forth and back direction printing can be renewed at an optimum value only by selecting and inputting from an arrangement condition of the test printing pattern, which is printed by displacing the correction value with respect to the detected print head position against to the present correction value at a predetermined value in the front and rear direction.

Therefore, it can be dispensed with a simple operation, further it is possible to maintain a high quality printing in the forth and back direction printing at the longitudinal ruled lines and the graphics etc. using the forth and back direction printing practicable printing apparatus such as a wire dot printer, and further an a high speed printing (improvement in a throughput) of the document data can be obtained.

BRIEF DESCRIPTION OF THE DRAWINGS

FIG. 11 shows a display screen of a display apparatus of the word processor shown in FIG. 8 displaying a work menu;

FIG. 12 shows the display screen of the display apparatus of the word processor shown in FIG. 8 displaying a supplementary menu;

FIG. 13 shows the display screen of the display apparatus of the word processor shown in FIG. 8 displaying a printing correction menu;

FIG. 14 shows the display screen of the display apparatus of the word processor shown in FIG. 8 displaying a selection input menu;

DESCRIPTION OF THE INVENTION

A method for correcting a drift of a printing position and a printing apparatus for practicing the same according to the present invention will be explained as follows.

First of all, a method for correcting a drift of a printing position in a forth and back direction printing using a printing apparatus itself and a printing apparatus for practicing the printing position drift correction method will be explained referring to FIGS. 1–6.

Figure 4:
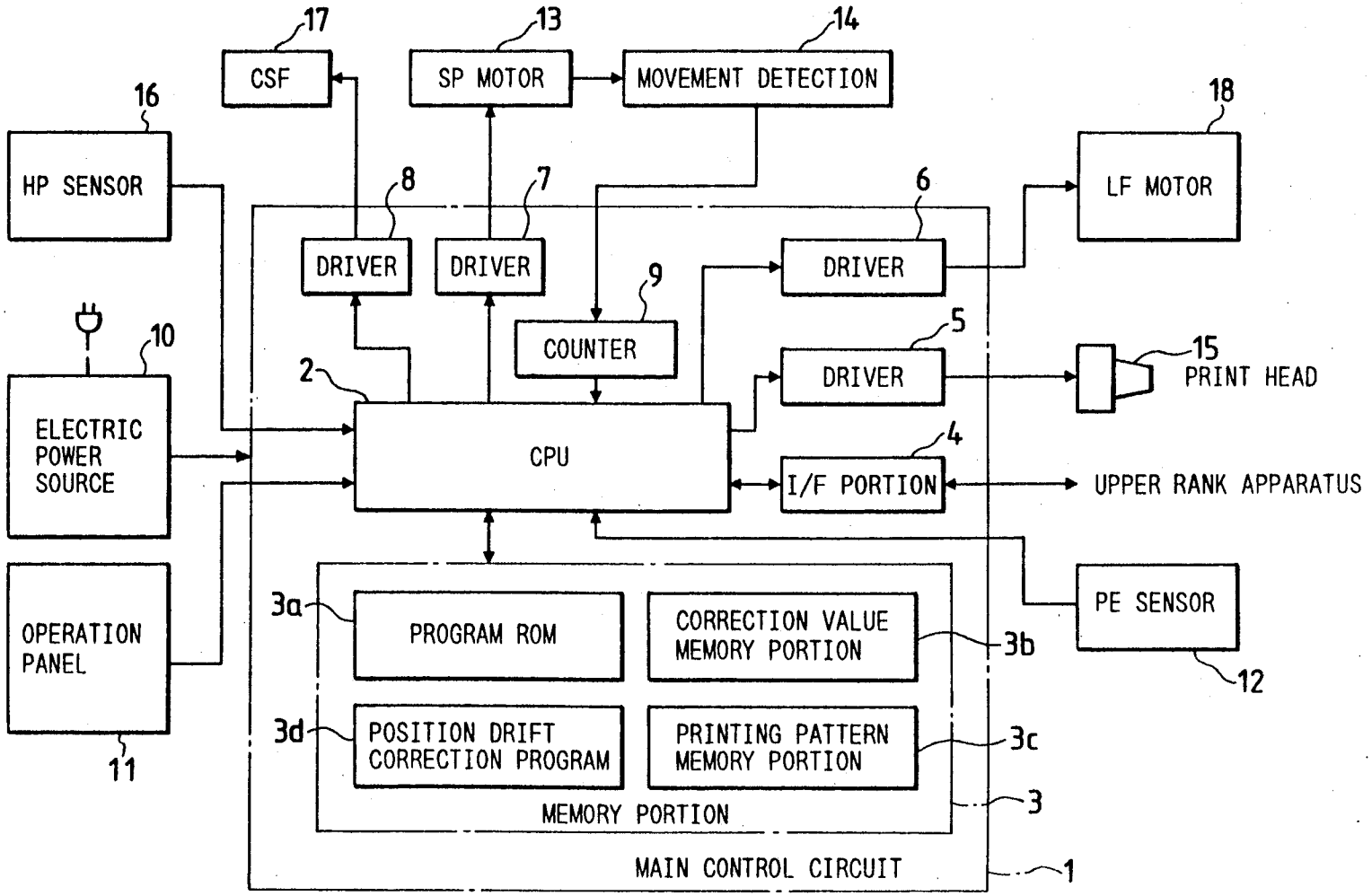
FIG. 4 is a control circuit block diagram of a printing apparatus which performs the printing position drift correction method shown in FIG. 1.

FIG. 4 is a control circuit block diagram showing a printing apparatus for practicing the printing position drift correction method according to the present invention.

A main control circuit 1 comprises an CPU (central processing unit) 2, a memory portion 3, an interface portion 4 for connecting between the main control circuit 1 and a higher rank apparatus, various kinds of drivers 5–8, and an up/down counter 9 for detecting a carriage position. The main control circuit 1 receives an electric supply from a power source portion 10 and carries out a data transfer between the main control circuit 1 and the higher rank apparatus according to an instruction input from an operation panel portion 11.

The printing apparatus comprises further a printing paper end detection sensor (PE sensor) 12 for detecting an existence of a printing paper, a carriage drive motor (space motor or SP motor) 13 such as a pulse motor, a movement detector 14 being connected to the carriage drive motor 13 and comprises a rotary encoder, a print head 15 being mounted on a carriage, a home position detection sensor (HP sensor) 16 for detecting a passage of a movement standard position (home position) of the print head 15, an automatic printing paper feed apparatus (cut sheet feeder or CSF) 17, and a printing paper line feed motor (LF motor) 18 as a drive source for moving the printing paper in a lengthwise direction.

The main control circuit 1 inputs an electric signal from the printing paper end detection sensor (PE sensor) 12, an electric signal outputted from the movement detector 14 at every rotation time of the carriage drive motor (SP motor) 13 with a predetermined amount, and an electric signal form the home position detection sensor (HP sensor) 16. The main control circuit 1 controls the automatic printing paper feed apparatus (CSF) 17 and the printing paper line feed motor (LF motor) 18 referring to the above stated various electric signals.

The print head 15 has a function in which 24 dots pattern part is printed in a printing paper feed direction (longitudinal direction) by a one-side way printing (a forth passage printing or a back passage printing), accordingly, during a printing operation for longitudinal ruled lines, an amount of a line feed amount has 24 dots part.

A rotation of the carriage drive motor (SP motor) 13 is converted so as to move at a forth and back direction the carriage in a printing paper width direction via a timing belt, a wire rope, and a rack and pinion gear etc. A distance (printing position) which is defined the print head 15 from the home position is detected from a counting value.

The counting value is determined by up/down counting the electric signal, which is outputted from the movement detector 14 by the up/down counter 9 in accordance with the movement direction of the carriage. When the carriage drive motor (SP motor) 13 employs a pulse motor, the movement detector 14 generates the electric signal in accordance with a motor drive pulse.

The memory portion 3 in the main control circuit 1 comprises a control program memory portion 3*a*, a correction value memory portion 3*b*, a printing pattern memory portion 3*c*, and a printing position drift correction program memory portion 3*d*. The above stated CPU 2 works together with this memory portion 3.

In this memory portion 3, the control program memory portion 3*a* controls the printing apparatus. The correction value memory portion 3*b* memorizes a correction value for correcting a drift of a printing position of the print head 15 against as an actual position. The position of the print head 15 is recognized from an amount of rotation of the carriage drive motor (SP motor) 13, in other words a counting value in the up/down counter 9.

The printing pattern memory portion 3*c* memorizes a test pattern printing and a document printing pattern memory portion 3*d* carries out a correction processing of the printing position. The correction value memory portion 3*b* employs $E^2$PROM so as to maintain the memory of the correction value, even if the electric power source become a break down.

The carriage mounts the print head 15 and is driven to move at a forth and back direction in the printing paper width direction (a right and left direction) by the carriage drive motor (SP motor) 13. The carriage includes further a drive mechanism for driving an ink ribbon (not shown in drawing).

Figure 5A:
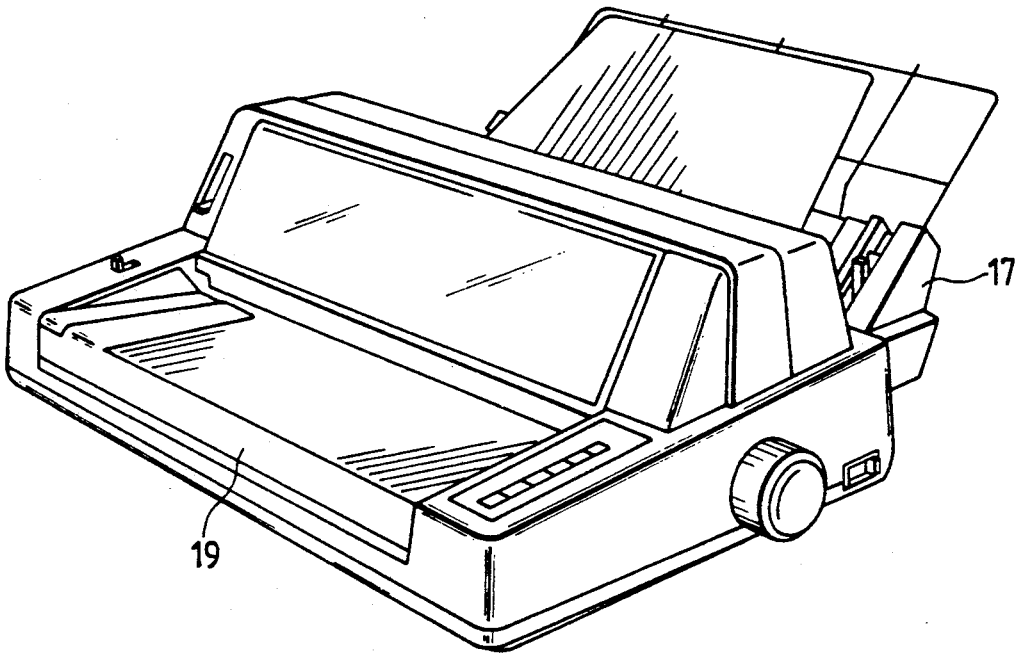
FIG. 5A shows the external appearance of the printing apparatus shown in FIG. 4.
Figure 5B:
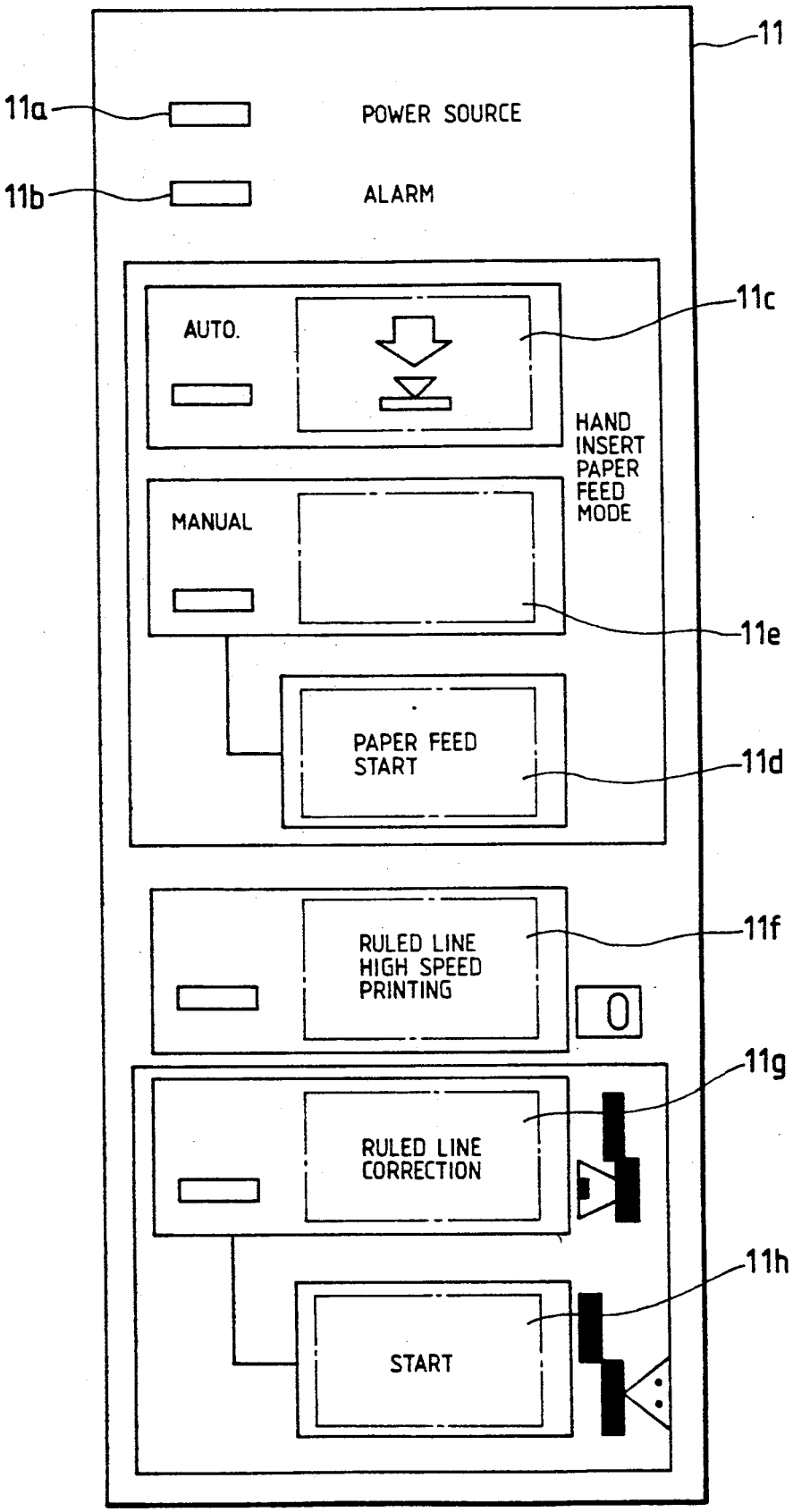
FIG. 5B shows an operation panel of the printing apparatus shown in FIG. 4.

The operation panel portion 11 in the printing apparatus comprises, as shown in FIG. 5, an electric power lamp 11*a*, an alarm lamp 11*b*, and various switch means 11*c*–11*h* so as to carry out the test pattern printing and the printing position drift correction processing etc. by the printing apparatus itself. The operation panel portion 11 of the printing apparatus works together with CPU 2.

The electric power lamp 11*a* indicates the condition showing the true supply of the electric power source to the printing apparatus. The alarm lamp 11*b* indicates the abnormal condition in the printing apparatus, and turns on and off during occurrence of the abnormal condition. The switch means 11*c*–11*h* select a printing paper manual insertion mode in which the printing paper is fed one sheet each from a front table 19 of the printing apparatus.

The switch means comprises an automatic switch 11*c*, a printing paper feed start switch 11*d* and a manual switch 11*e*. The automatic switch 11*c* indicates a printing paper automatic feed mode, after the printing paper is pushed against the printing end detection sensor (PE sensor) 12 by inserting the printing paper into the front table 19.

With the condition in which the printing paper is pushed against the printing end detection sensor (PE sensor) 12 and the printing paper feed start switch 11*d* is pushed down, then the manual switch 11*e* indicates the start of the feed operation for the printing paper. CPU 2 responds to change the automatic/manual printing paper feed mode every push-down of each switch.

Further, the switch means includes a ruled line high speed printing switch 11*f*. CPU 2 responds to change over every push-down of the ruled line high speed printing switch 11*f* so as to whether follow to the indication of the printing direction from the upper rank apparatus or carry out compulsively the forth and back direction printing.

Further, the switch means comprises a ruled line correction switch 11*g* for indicating the carry out the processing in which the printing position drift of the forth and back direction printing according to the present invention is corrected, and a start switch 11*h* for indicating the start of the pattern printing for correcting the printing position drift. CPU 2 responds to the indication input by the switch means 11*c*–11*h* so as to work the following functions.

When the ruled line correction switch 11*g* is pushed down, it becomes the printing position drift mode, and when the start switch 11*h* is pushed down and the condition is under the printing paper feed condition, the pattern printing for correction of the printing position drift is read from the pattern printing memory portion 3*c* and prints the pattern printing.

Further, during the processing of the printing position drift mode, the ruled line correction switch 11*g* is determined and processed as a correction processing finish switch, and the ruled line correction switch 11*g* and the start switch 11*h* are determined and processed as a correction value renewal selection switch.

Figure 6:
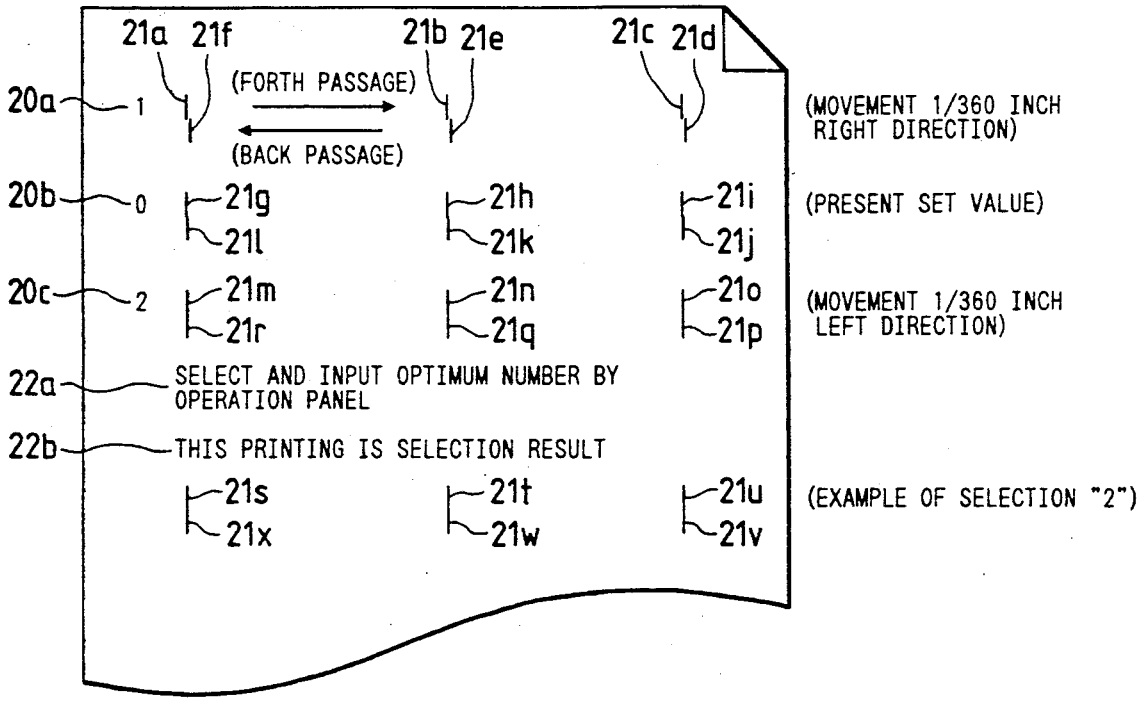
FIG. 6 shows an example of printing position drift detection patterns and messages which are printed out while performing the printing position drift correction method shown in FIG. 1 when a printing position drift correction value is within a predetermined correction limit.

Next, the printing position drift correction processing according to the present invention will be explained referring to the processing flow charts of CPU 2 shown in FIG. 1, FIG. 2 and FIG. 3 and further referring to the printing examples shown in FIG. 6 and FIG. 7.

First of all, a judgment processing 1100 is carried out whether or not the ruled line correction switch 11*g* of the operation panel portion 11 is pushed down. Namely, this judgment processing 1100 carries out the necessity for the carrying out the printing position drift correction processing. Under the condition in which the ruled line correction switch 11*g* is not pushed, another processing 1200 carries out. This another processing 1200 is a processing for waiting the document data receipt from the upper rank apparatus or a processing for carrying out the printing operation after the receipt of the document data etc.

When the ruled line correction switch 11*g* is pushed down, an initial set processing 1300 for correcting the printing position drift carries out. In this initial set processing 1300, the following processing is carried out. Namely, the carriage is moved and the home position detection sensor (HP sensor) is gone cross the print head 15. Then the carriage is stopped by setting the calculation value of the up/down counter 9 at a value from the home position, and the printing position drift correction program mode is made to be carry out condition and so on.

Next, a processing 1400 is carried out in which whether or not the printing paper for printing the pattern for correcting the printing position drift is fed. When the printing paper is not fed, a printing paper feed processing 1500 is carried out.

When the push-down of the start switch 11*h* is detected in a processing 1600, the printing position drift correction mode printing processing 1700 carries out.

The printing position drift correction mode printing processing 1700 will be explained in detail referring to FIG. 2 as follows. In this printing position drift correction mode printing, in the first place, a first forth passage printing 1701 is carried out. In a processing 1701*a*, the carriage drive motor (SP motor) 13 is rotated normally so as to move the carriage in the forth passage direction. In a processing 1701*b*, the position of the carriage is detected by reading the counting value of the up/down counter 9 under the up-count condition.

In a processing 1701*c*, the selection number pattern and the printing position drift detection pattern (a longitudinal ruled line) are read on in a predetermined detection position which is set in the printing position drift correction program, and drive (prints) the print head 15. When the first forth passage printing 1701 has finished, in a processing 1701*d* the carriage drive motor (SP motor) 13 is decelerated and stops. This test pattern printing example in the first forth passage printing 1701 is indicated in the selection number 20*a* (selection mark "1") and the printing position drift detection patterns 21*a*–21*c* as shown in FIG. 6.

Next, in a processing 1702, the printing paper line feed motor (LF motor) 18 is driven and after the printing paper is sent 24 dots (one line) part in the lengthwise direction, in a processing 1703 the printing position is changed in the right direction one pitch rate at the counting value against the detection position by the counting value of the up/down counter 9. The one pitch rate at the counting value is a minimum movement amount of the carriage and is detected by the movement detector 14. In this example, the one pitch rate at the counting value is 1/360 inch.

A processing 1704 is a first back passage printing processing. In a processing 1704*a*, the carriage drive motor (SP motor) 13 is rotated reversely so as to move the carriage in the back passage direction. In a processing 1704*b*, after the counting value of the up/down counter 9 under the down-count condition is read out, the position of the carriage is detected by adding the correction value which is memorized in the correction value memory portion 3*b*.

In a processing 1704*c*, the printing position drift pattern is read on in a predetermined position, which is set in the printing position drift correction program (one pitch right side rate against the printing position of the forth passage printing) against this detection position, and drives (prints) the carriage. When the first back passage printing has finished, the carriage drive motor (SP motor) 13 is decelerated and stops. This test printing pattern example in the first back passage printing 1704 is indicated the printing position drift detection patterns 21*d*–21*f* as shown in FIG. 6.

Next, in a processing 1705 the printing paper line feed motor (LF motor) 18 is driven for the second forth passage printing and carries out the sending for the printing paper at a predetermined amount.

A second forth passage printing processing is shown in a processing 1706. This second forth passage printing processing 1706 is same that of the first passage printing processing 1701. This test printing pattern example in the second forth passage printing 1706 is indicated in the selection number 20*b* (selection mark "0") and the printing position drift detection patterns 21*g*–21*i* as shown in FIG. 6.

Next, in a processing 1707, the printing paper line feed motor (LF motor) 18 is driven and after the printing paper is sent 24 dots (one line) part in the lengthwise direction, in a processing 1708 the printing position is changed in the right direction one pitch rate at the counting value against the detection position by the counting value of the up/down counter 9.

A processing 1709 is a second back passage printing processing for carrying out the printing at the above stated set position. This second back passage printing processing 1709 is carried out similar to that of the first back passage printing processing 1704. The printing position becomes a detected position by adding only the correction value to the up/down counter counting value in the forth passage printing. This test printing pattern example in the second back passage printing 1709 is indicated the printing position drift detection patterns 21*j*–21*l* as shown in FIG. 6.

Next, in a processing 1710 the printing paper line feed motor (LF motor) 18 is driven for the third forth passage printing and carries out the sending for the printing paper at a predetermined amount.

A third forth passage printing processing is shown in a processing 1711. This third forth passage printing processing 171 is same that of the first passage printing processing 1701. This test printing pattern example in the third forth passage printing 171 is indicated in the selection number 20*b* (selection mark "2") and the position drift detection patterns 21*m*–21*o* as shown in FIG. 6.

Next, in a processing 1712, the printing paper line feed motor (LF motor) 18 is driven and after the printing paper is sent 24 dots (one line) part in the lengthwise direction, in a processing 1713 the printing position is changed in the direction one pitch rate at the counting value against the detection position by the counting value of the up/down counter 9. The one pitch rate at the counting value is a minimum movement amount of the carriage and is detected by the movement detector 14. In this example, the one pitch rate at the counting value is 1/360 inch.

A processing 1714 is a third back passage printing processing for carrying out the printing at the above stated set position. This third back passage printing processing 1714 is carried out similar to that of the first back passage printing processing 1704.

The printing position is controlled so as to be one pitch rate in the left direction against the detected forth passage position. This test printing pattern example in the third back passage printing processing 1714 is indicated in the printing position drift detection patterns 21*p*–21*r* as shown in FIG. 6.

Next, in a processing 1715 the printing paper line feed motor (LF motor) 18 is driven for the message printing, which prints the result of the selection, and carries out the sending for the printing paper at a predetermined amount.

Figure 1:
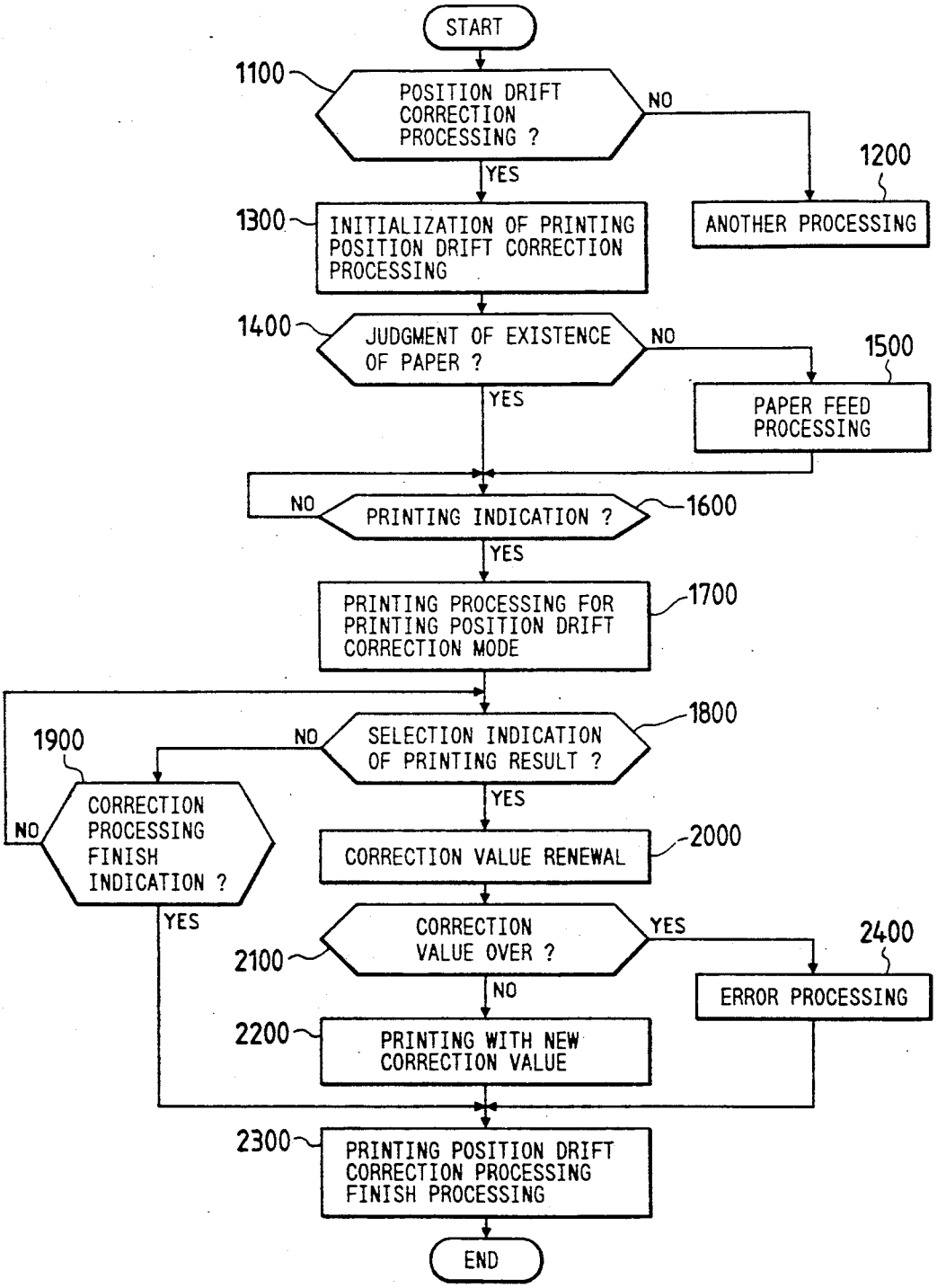
FIG. 1 is a flow-chart for a program carried out by a CPU in a main control circuit showing a method for correcting a drift of a printing position according to the present invention.
Figure 2:
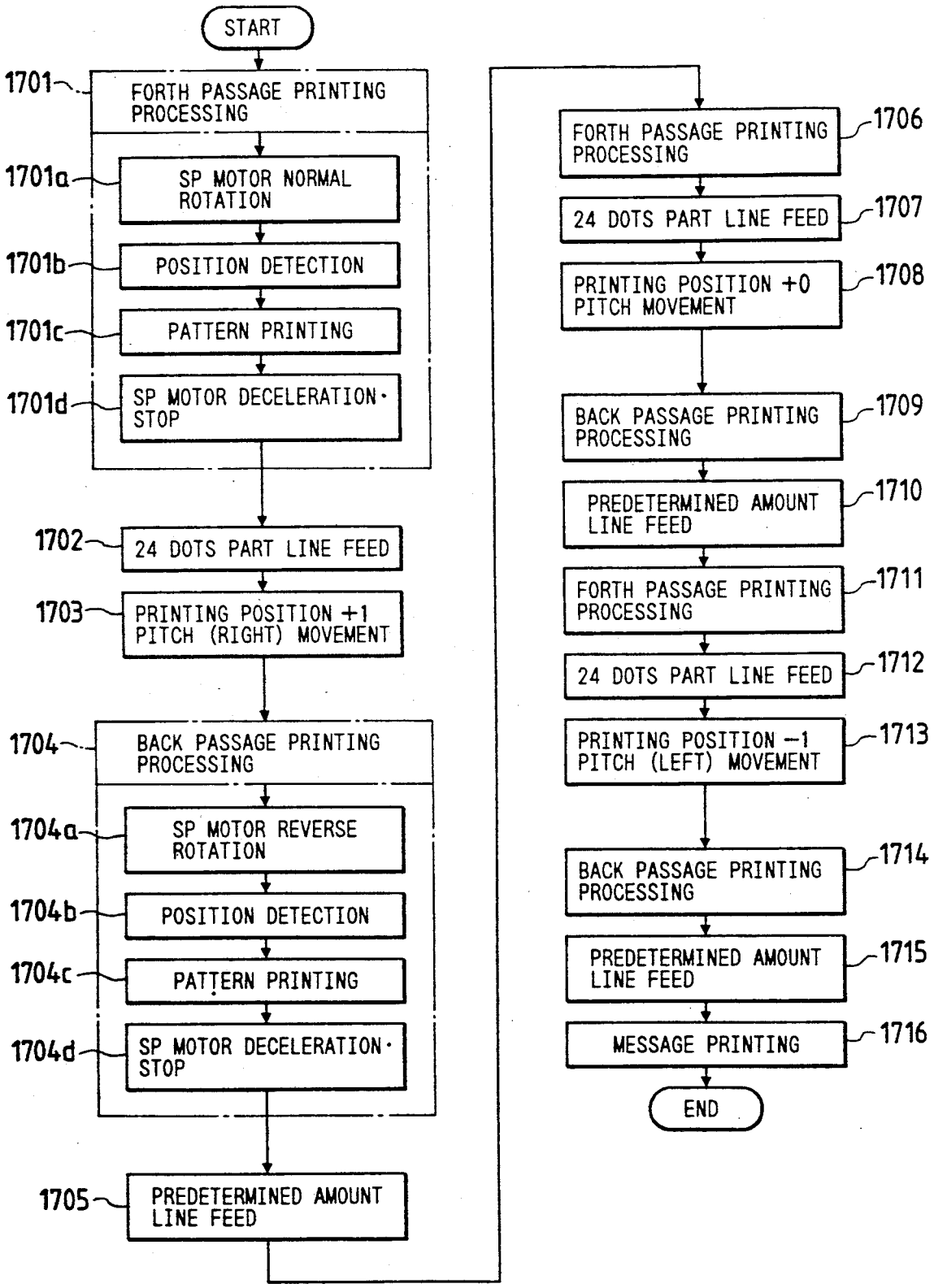
FIG. 2 is a flow-chart for a printing position drift correction mode printing processing 1700 shown in FIG. 1.

In a message processing 1716, a message 22*a*, which is selected and inputted by the operation panel portion 11 from the selection numbers 20*a*–20*c*, is printed and the printing processing of the printing position drift correction has finished, and after the processing moves to a processing 1800 shown in FIG. 1. The message 22, which is selected form the selection numbers 20*a*–20*c*, has a relation of the smallest little printing position drift among the corresponding forth and back direction detection patterns referring to the printing position drift detection patterns 21*a*–21*r*.

In the processing 1800, the necessary for the renewal of the correction value is judged by watching the input signal from the ruled line correction switch 11*g* or the start switch 11*h* of the operation panel portion 11. In a processing 1900, the necessary for the finish of the correction processing is determined by watching the input signal from the ruled line high speed printing switch 11*f*. When input signal from the ruled line correction switch 11*g* or the start switch 11*h* is detected, the processing moves to a processing 2000 and then the renewal processing for the correction value is carried out.

In this correction value renewal processing 2000, when the selection number 20*a* (selection mark "1") is selected and it is the input signal from the ruled line correction switch 11*g*, the correction value which is memorized in the correction value memory portion 3*b* is made +1. When the selection number 20*c* (selection mark "2") is selected and it is the input signal from the start switch 11*h*, the correction value which is memorized in the correction value memory portion 3*b* is made −1. This correction value renewal may be made the correction value +1 or −1 every signal input time from the ruled line correction switch 11*g* or the start switch 11*h*.

After that, the processing moves to a processing 2100, in this processing 2100 it determined whether or not the correction value after the renewal exceeds a predetermined correction limit. When the correction value after the renewal is within the predetermined correction limit, the processing moves to a processing 2200. In this processing 2200, a message for indicating the printing with new correction value and the printing position drift detection patterns 21*s*–21*x* at the forth and back passage printing referring to the new correction value are printed, and a printing position drift correction finish processing 2300 is carried out.

In the processing 1900, when the input signal from the ruled line high speed printing switch 11*f* is detected, since the correction is unnecessary, the printing position drift correction finish processing 2300 is carried out immediately.

Figure 7:
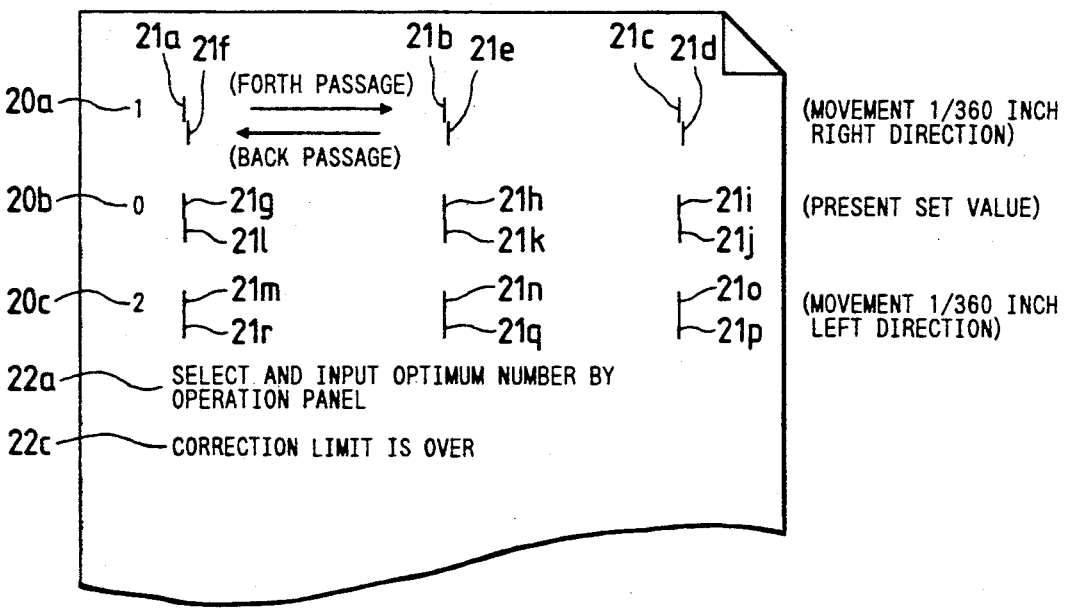
FIG. 7 shows an example of printing position drift detection patterns and messages which are printed out while performing the printing position drift correction method shown in FIG. 1 when a printing position drift correction value exceeds a predetermined correction limit.

In the processing 2100, when the correction value after the renewal is detected to be more than the predetermined correction limit, as shown in FIG. 7, a message 22*c* indicating an abnormal condition in an error processing 2400 is printed, and the printing position drift correction finish processing 2300 is carried out.

Figure 3:
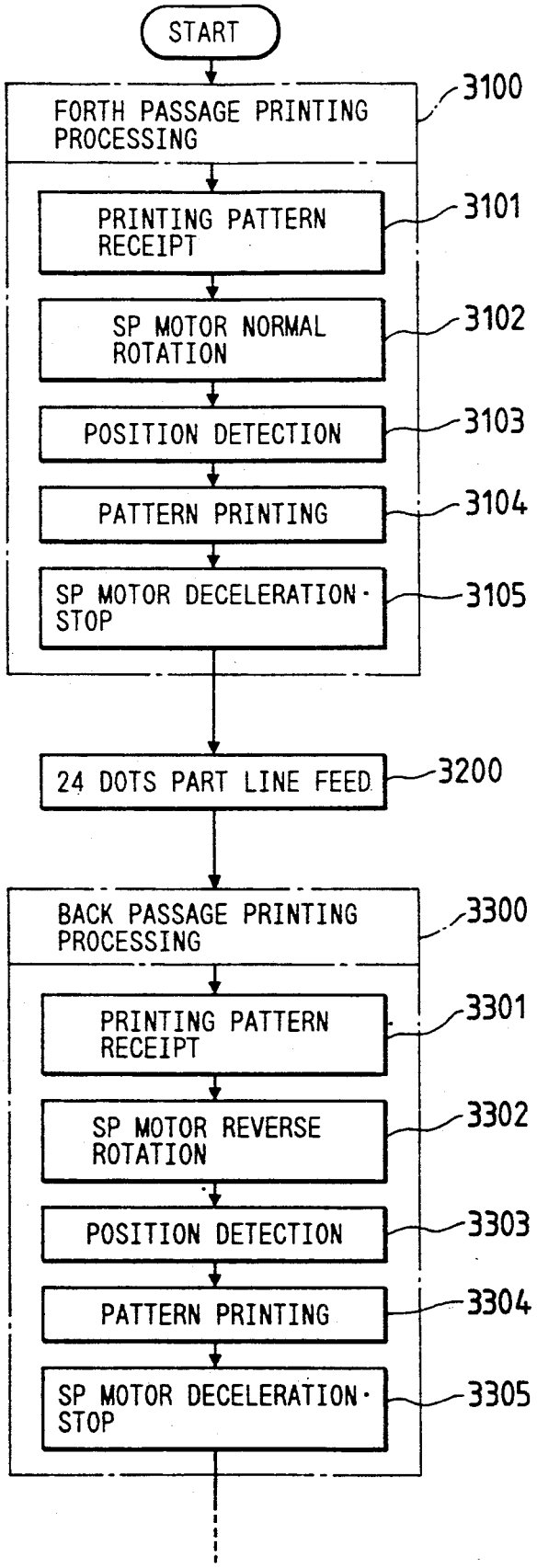
FIG. 3 is a flow-chart for a program carried out by a CPU in a main control circuit showing a document printing processing for printing a document after the printing position drift correction method shown in FIG. 1 has been performed.

The document printing processing including the longitudinal ruled lines in the printing apparatus is shown in FIG. 3. In the printing apparatus, the printing position drift correction value has set. In this printing processing, odd number line is carried out in the forth passage printing, and even number line is carried out the back passage printing. Previous to each line printing, the document printing pattern having the first one line part is received from the upper rank apparatus and is memorized in the printing pattern memory portion 3*c*.

In a printing processing 3100 for the odd number lines, in advance, in a processing 3101 the document printing pattern having the first one line part is received from the upper rank apparatus and is memorized in the printing pattern memory portion 3*c*. After that, in a processing 3102, the carriage drive motor (SP motor) 13 is driven normally and moves the carriage in the forth passage direction.

In a processing 3103, the position of the carriage is detected from the counting value of the up/down counter 9. In a processing 3104, the printing pattern is read out from the printing pattern memory portion 3*c* and is printed on a predetermined printing position. When the document pattern for printing the first one line part is run out, a processing moves to a processing 3105 and the carriage drive motor (SP motor) 13 is decelerated and stops.

In a processing 3200, the printing paper line feed motor (LF motor) 18 is driven and transfers the printing paper, thereby the line feed processing having 24 dots part is carried out.

In a printing processing 3300 for the even number lines, in advance, in a processing 3301 the document printing pattern having second one line part is received from the upper rank apparatus and is memorized in the printing pattern memory portion 3*c*. After that, in a processing 3302, the carriage drive motor (SP motor) 13 is driven reversely and moves the carriage in the back passage direction.

In a processing 3303, the counting value of the up/down counter 9 is read on and the counting value is corrected according to the correction value read on from the correction memory portion 3*b*, and the position of the carriage is detected. In a processing 3304, the printing pattern is read out from the printing pattern memory portion 3*c* and is printed on a predetermined printing position. When the document pattern for printing the second one line part is run out, the processing moves to a processing 3305 and the carriage drive motor (SP motor) 13 is decelerated and stops.

As stated above, the forth and back passage printing is carried out repeatedly and the document printing including the ruled lines is carried out.

According to the example of the present invention described above, as the correction processing for correcting the printing position drift in the forth passage printing and the back passage printing, the printing position detection in the back passage is corrected by the counting value from the up/down counter 9.

However, the calculating method for the printing position is not limited to only the method described above, but the indicating value for the printing position against the counting value may be changed in the forth passage printing or the back passage printing. The initial value for the counting value of the up/down counter 9 may be changed in the forth passage printing or the back passage printing.

In a word, during the forth and back passage movement of the carriage, the occurrence timing of the electric signal from the movement detector 14 is corrected in accordance with the history characteristic of the driving force transmission in the driving system.

Next, a word processor embodying the printing position drift correction method according to the present invention will be explained referring to FIGS. 8–14.

Figure 8:
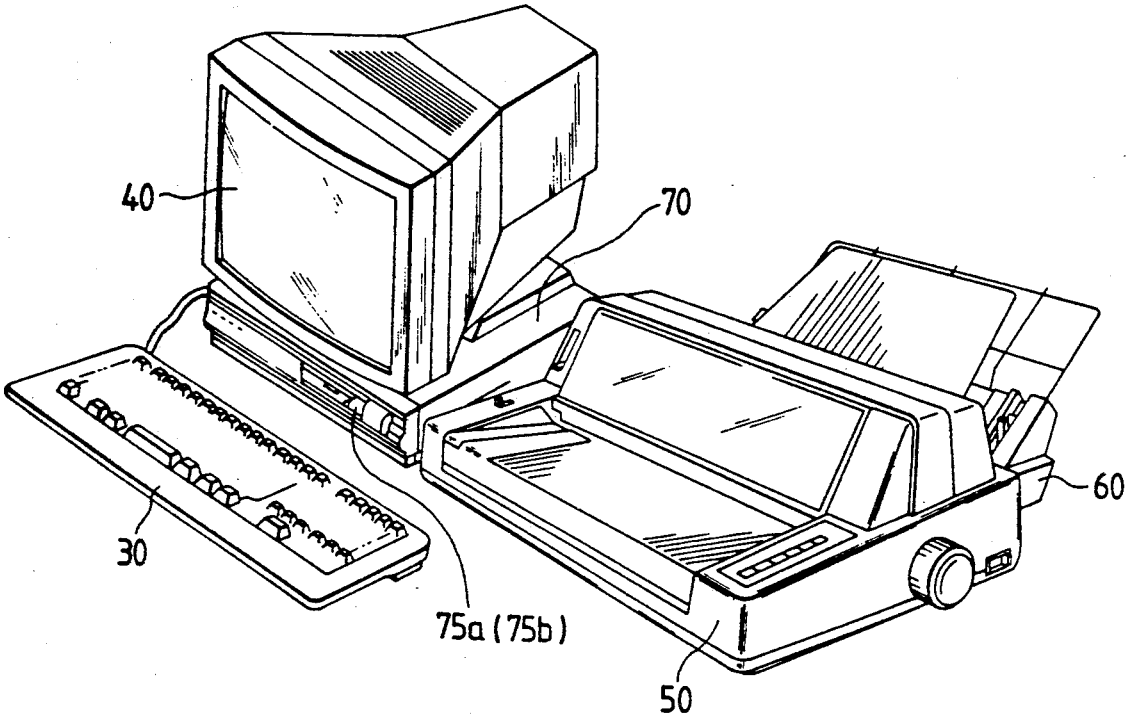
FIG. 8 shows the external appearance of a word processor which performs a printing position drift correction method according to the present invention.

As shown in FIG. 8, the word processor comprises an input apparatus 30 for inputting a character code and a control command etc., a display apparatus 40 for displaying such as a character information inputted from the input apparatus 30, a printing apparatus 50, an automatic cut sheet printing paper feed apparatus (CSF) 60 mounted on the printing apparatus 50, and a total control apparatus 70 for controlling totally the above stated various apparatuses.

Figure 9:
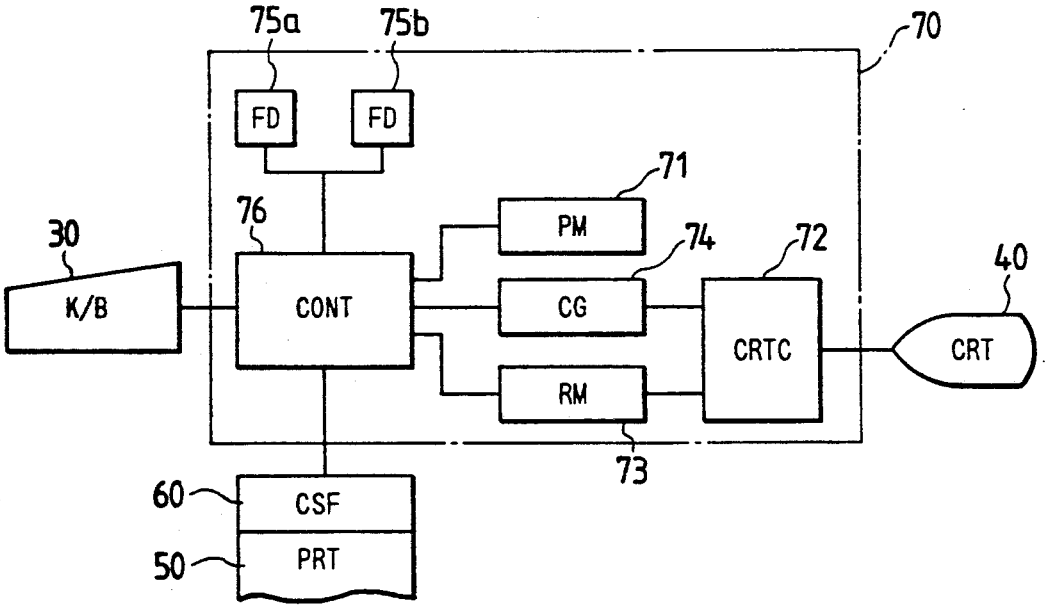
FIG. 9 is a control circuit block diagram of the word processor shown in FIG. 8.
Figure 10:
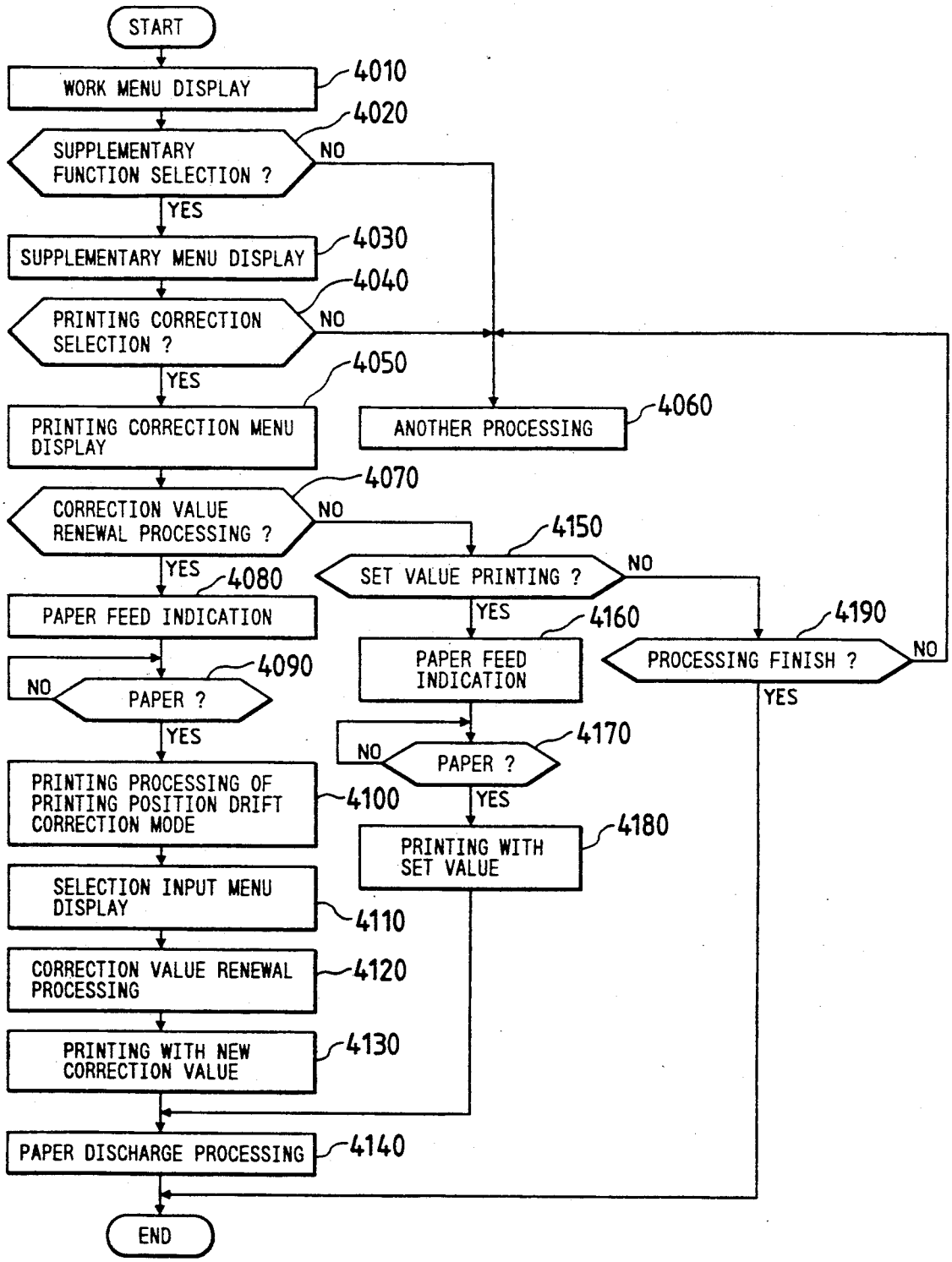
FIG. 10 is a flow-chart for a program carried out by a CPU in a main control circuit of the word processor shown in FIG. 8 showing a printing position drift correction method according to the present invention corresponding to the printing position drift correction method shown in FIG. 1.

As shown in FIG. 9, the total control apparatus 70 comprises a temporary memory means (page memory:PM) 71 for memorizing the character information, the control demand information and the management information etc., a display controller (CRTC) 72, a refresh memory (RM) 73, a character generator (CG) 74, a first and a second flexible disk apparatuses 75*a*, 75*b* which are outside memory apparatuses, and a main control circuit 76.

The main control circuit 76 constitutes of mainly an CPU and the control functions thereof are determined according to the programs stored in the installed memory apparatus. The main control circuit 76 controls totally the various apparatuses during the document editing operation and the printing operation.

The first flexible disk apparatus 75*a* stores the system program and a kanji (Chinese character) conversion dictionary. The second flexible disk apparatus 75*b* memories and preserves the past preparation document and the newly preparation document. The page memory (PM) 71 memorizes temporarily the document information inputted from the input apparatus 30 or the document information read out from the second flexible disk apparatus 75*b*.

The refresh memory (PM) 73 memorizes a character line of the document, which is indicated by the display apparatus 40, in a form of number cord which means the store number of the character pattern in the character generator (CG) 74. The character generator (CG) 74 memorizes the character pattern. The display controller (CRTC) 72 reads out the number code of the character line to be displayed from the refresh memory (PM) 73 and converts it to the character pattern using the character generator (CG) 74. The display controller (CRTC) 72 carries out the display for the document character pattern in the display apparatus 40.

The printing apparatus 50 receives the signal, which is converted in a form of the character pattern, from the document information stored in the second flexible disk apparatus 75*b* or the page memory (PM) 71 using the character generator (CG) 74, thereby the document printing carries out.

In the above stated word processor construction, the main control circuit 76 has an ROM which memorizes a part of programs as a part of the internal memory apparatus. During the make-up of the electric power source, the programs are transferred to an RAM area of the first flexible disk apparatus 75*a* by this ROM of the main control circuit 76, thereby the motion preparation becomes to be finished.

When the document edition mode (at the work menu display screen in FIG. 11, this document edition mode corresponds to "1 document renewal preparation" and is selected the number input from the input apparatus 30) is set, the main control circuit 76 carries out the document edition format set processing for editing the document.

In this document edition format set processing, the format set items are displayed in the display apparatus 40, and the format information, which is inputted by the operator from the input apparatus 30, is memorized.

The format set items include the printing paper size, the printing paper direction, margin values at upper, lower, right and left portions, the character size, the character space, and the line space etc. The character information, which is inputted after the document edition format set, is managed according to this format information.

Next, when the document printing mode is selected, the main control circuit 76 carries out the document printing format set processing for printing the document. In this document printing format set processing, the format set items are displayed in the display apparatus 40, and the format information, which is inputted by the operator from the input apparatus 30, is memorized.

In this document printing format set items include the document name to be subjected the printing or the document number, the printing numbers of copies, the printing page range, the page numbering range, the page numbering start number, the printing paper feed method (automatic/manual), and the printing direction indication etc. The main control circuit 76 carries out the document data printing control processing referring to the document edition format and the document printing format information.

After the set for the document printing format, when a printing key mounted on the input apparatus 30 is inputted, the main control circuit 76 sends a control code for the printing to the printing apparatus 50. This control code includes further a control code for including the forth and back direction/one-way direction printing.

Next, one embodiment of the printing position drift correction mode in the forth and back direction printing according to the present invention will be explained referring to FIGS. 10–16.

When the above stated main control circuit 76 becomes an operation preparation finish condition, in a processing 4010, a work selection menu is displayed on the display screen of the display apparatus 40, as shown in FIG. 11. And it waits the selection input about "5 supplementary function" from the input apparatus 30 in a processing 4020.

When the selection input about "5 supplementary function" carries out, the preparation for the supplementary function processing is finished by activating the supplementary function processing program, and a supplementary function selection menu is displayed in the display apparatus 40 as shown in FIG. 12. This supplementary functions have the document management and the floppy copy etc. and further includes the printing position drift correction processing according to the present invention.

In a processing 4040, when the selection input about "9 printing correction" is detected from the input apparatus 30, the printing position drift correction program is activated, the printing position drift correction mode becomes the operation preparation finish condition, and a processing 4050 for displaying the printing position drift correction menu is carried out. In a case that a processing menu excepted the above stated processing menu is selected and inputted, then another processing 4060 is carried out.

This printing position drift correction mode includes a menu about "1 correction value renewal" for carrying out a processing in which the correction value is renewed by detecting the printing position drift in the forth and back direction printing and a menu about "2 set value printing" for carrying out a processing in which the printing pattern for detecting the printing position drift is printed using the set correction value and so on.

In a processing 4070, it is determined whether or not the selection input from the input apparatus 30 is the printing processing at the correction value, in which the renewal processing of the correction value, is set. When the menu "1 correction value renewal" from the input apparatus 30 is selected and inputted, the printing paper feed indication for the printing paper to the printing paper automatic feed apparatus (CSF) 60 is carried out.

After a processing 4090, in which whether or not it detects that the printing paper is fed to the printing apparatus 50, is carried out, a printing position drift correction mode printing processing 4100 is carried out.

The printing position drift correction mode printing processing 4100 is carried out similar to that of the printing position drift correction mode printing processing 1700 in FIG. 1.

Figure 15:
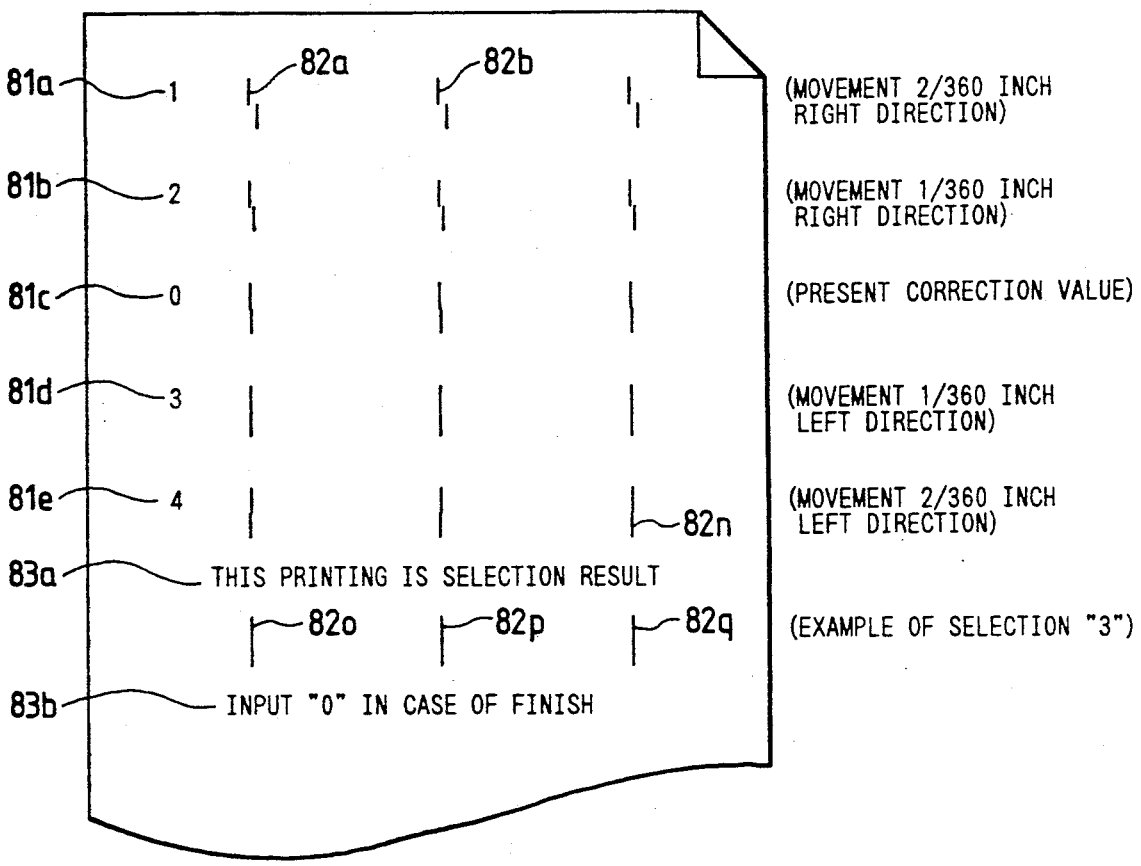
FIG. 15 shows an example of printing position drift detection patterns and messages which are printed out while the word processor shown in FIG. 8 is performing the printing position drift correction method shown in FIG. 10.

According to the input apparatus 30 of the word processor, it can increase the number of the selection input, so that it can process so as to carry out the printing at the detection position which moves 2 pitches against the past set correction value. In a printing example of this case, there are the selection numbers 81*a*–81*e* and the printing position drift detection patterns 82*a*–82*n*, as shown in FIG. 15.

When the printing position drift correction mode printing processing 4100 is finished, in a processing 4110, a processing for displaying an optimum printing result selection input menu in the display apparatus 40 is carried out.

When there is the selection input from the input apparatus 30, the move pitch, in which the forth and back direction printing of the selected number is carried out, is obtained, and a correction value renewal processing 4120 for the correction value is carried out.

After that the processing moves to a processing 4130. In this processing 4130, as shown in FIG. 15, after the messages 83*a*, 83*b* and the printing position drift detection patterns 82*o*–82*q* are printed by the forth and back direction printing with the renewal correction value, and a printing paper discharge processing is carried out in a processing 4140.

When in a processing 4070 the selection input except for the correction value renewal is detected, the processing moves to a processing 4150. In this processing 4150, it is determined whether the selection input of the printing processing is the printing processing at the set correction value or not. When the selection input about "2 set value printing" is detected, in a processing 4160 the printing paper feed indication to the printing paper automatic feed apparatus (CSF) 60 is carried out.

Figure 16:
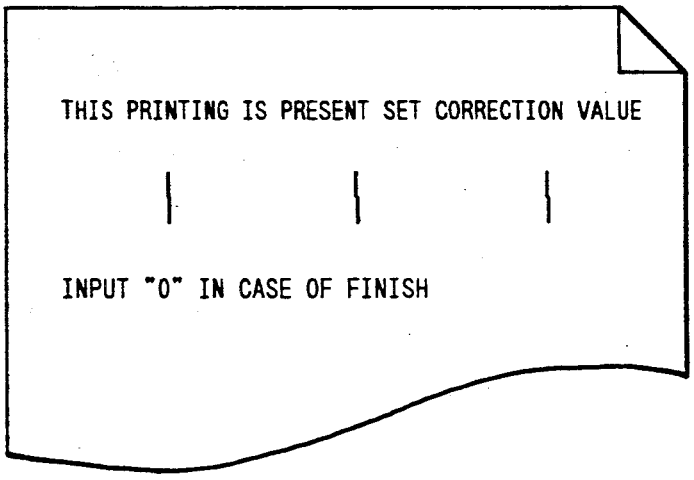
FIG. 16 shows an example of printing position drift detection patterns and messages which are printed out by the word processor shown in FIG. 8 using a presently set printing position drift correction value.

After a processing 4170, in which whether the feed of the printing paper to the printing apparatus 50 is detected or not, is carried out, a forth and back direction printing processing 4180 for printing the printing position drift detection pattern is carried out by practicing the position detection for the carriage using the present set correction value. A printing example in this case is shown in FIG. 16. After the forth and back direction printing processing 4180 is finished, the printing paper discharge processing 4140 is carried out.

When in the processing 4150 the selection input about "2 set value printing" is not detected, the processing moves to a processing 4190. In this processing 4190, it determined whether the selection input about "0 finish" is or not, and the printing position drift correction mode is finished or it moves to a processing 4060 and carries out another processing.

In the example of the present invention described above the processing for the printing position drift correction function in the word processor is carried out by the main control circuit 76, but part of the processing may be carried out by a main control circuit which is provided on the printing apparatus 50.

The document printing processing using the above stated set (renewal) correction value is carried out similar to the document printing processing shown in FIG. 3.

We claim:

1. A method for correcting a drift of a printing position in which a print head is moved toward a forth and back direction at a width direction of a printing paper, said printing paper is moved in a lengthwise direction of said printing paper, a movement signal occurs every predetermined amount of a movement of said print head and is counted, said print head prints a printing pattern by reading said printing pattern in accordance with a predetermined detection position which is indicated by a counting value of said movement signal, an input apparatus prints said printing pattern on said printing paper, and a printing position drift, which is relative to at a width direction during a forth passage printing and a back passage printing in said input apparatus, is corrected wherein in a printing with a printing position correction mode;

in one of said forth and back movement of said print head, a first test printing pattern control for moving said print head is carried out by occurring a first test printing pattern at a predetermined detection position which is indicated by said counting value;

in the other of said forth and back movement of said print head, a second test printing pattern control for moving said print head is carried out by occurring a second test printing pattern at a predetermined detection position which is indicated by said counting value, said second test printing pattern is occurred at a displacement position with an amount of a predetermined movement in a front side or in a rear side with respect to said predetermined detection position;

by selecting and inputting a relative test printing pattern, which is printed during a forth and back direction printing and has a minimum printing position drift, a displacement value in a one-way test printing pattern control for printing a selected test printing pattern is detected; and a detection position correction value is obtained and memorized in accordance with said detected displacement value.

2. A method for correcting a drift of a printing position in which a print head is moved toward a forth and back direction at a width direction of a printing paper, said printing paper is moved in a lengthwise direction of said printing paper, a movement signal occurs every predetermined amount of a movement of said print head and is counted, said print head prints a printing pattern by reading said printing pattern in accordance with a predetermined detection position which is indicated by a counting value of said movement signal, an input apparatus prints said printing pattern on said printing paper, and a printing position drift, which is relative to at a width direction during a forth passage printing and a back passage printing in said input apparatus, is corrected wherein in a printing with a document printing mode;

in one of said forth and back movement of said print head, a first test printing pattern control for driving said print head is carried out by occurring a first test printing pattern at a predetermined detection position which is indicated by said counting value;

in the other of said forth and back movement of said print head, a second test printing pattern control for moving said print head is carried out by occurring a second test printing pattern at a predetermined detection position which is indicated by said counting value, said second test printing pattern is occurred at a displacement position with an amount of a predetermined movement in a front side or in a rear side with respect to said predetermined detection position;

by selecting and inputting a relative test printing pattern, which is printed during a forth and back direction printing and has a minimum printing position drift, a displacement value in a one-way test printing pattern control for printing a selected test printing pattern is detected;

a detection position correction value is obtained and memorized in accordance with said detected displacement value; and a document pattern is printed by correcting a relative relation between a detection position during the forth passage printing and a detection position during the back printing in accordance with said memorized correction value.

3. A method for correcting a drift of a printing position according to claim 1, wherein in one of said first test printing pattern control and said second test printing pattern control with said printing position drift correction mode, said predetermined detection position is obtained by correcting a detection position, which is indicated by said counting value, in accordance with a beforehand memorized correction value.

4. A method for correcting a drift of a printing position in which a print head is moved toward a forth and back direction at a width direction of a printing paper, said printing paper is moved in a lengthwise direction of said printing paper, said print head prints a printing pattern by reading said printing pattern in accordance with a detection position of said print head, an input apparatus prints said printing pattern on said printing paper, and a printing position drift, which is relative to at a width direction during a forth passage printing and a back passage printing in said input apparatus, is corrected wherein in a printing with a printing position drift correction mode;

during one printing of the forth passage printing and the back passage printing, a test printing pattern control is carried out at a predetermined print head detection position, during the other printing of the forth passage printing and the back passage printing, a test printing pattern control is carried out at a displacement position with an amount of a predetermined movement against said predetermined print head detection position;

by selecting and inputting a relative test printing pattern, which is printed during a forth and back direction printing and has a minimum printing position drift, a displacement value in said test printing pattern control for printing a selected test printing pattern is detected; and a detection position correction value is obtained and memorized in accordance with said detected displacement value.

5. A method for correcting a drift of a printing position in which a print head is moved toward in a forth and back direction at a width direction of a printing paper, said printing paper is moved in a lengthwise direction of said printing paper, said print head prints a printing pattern by reading said printing pattern in accordance with a detection position of said print head, an input apparatus prints and said printing pattern on said printing paper, and a printing position drift, which is relative to at a width direction during a forth passage printing and a back passage printing in said input apparatus, is corrected wherein in a printing with a document drift correcting mode;

a relative relation between a detection position during the forth passage printing and a detection position during the back passage printing is corrected and printed in accordance with said memorized correction value.

6. An input apparatus comprising a print head mounted on a carriage, a carriage drive motor for driving said carriage toward a forth and back movement in a width direction of a printing paper, a home position detection means for detecting a home position of said print head, said home position for said print head is a standard position of a movement in the width direction of said print head, a print head position detection means for detecting a position with the home position of said print head, a printing pattern memory means for memorizing a printing pattern, said printing pattern is printed using said print head, a print head drive means for controlling a printing of said print head by reading out eh printing pattern from said printing pattern memory means in accordance with a position of said print head, said position of said print head is detected from said print head position detection means, a printing paper feed means for feeding said printing paper toward a lengthwise direction of said printing paper, and after a position is corrected with a predetermined amount against a position detection result of said print head, a printing position drift correction control means carries out the printing using said print head, wherein said print head position detection means includes a forth passage position detection means for detecting a present position of said print head in accordance with a counting value by addition-counting successively an electric signal generated every unit movement amount during a forth passage movement of said print head, and a back passage position detection means for detecting a present position of said print head in accordance with a counting value by subtraction-counting successively said electric signal generated every unit movement amount during a back passage movement of said print head;

said printing position drift correction means, in a printing with a printing position drift correction mode, includes a first test printing pattern control means for moving said print head by generating a test printing pattern at a predetermined detection position indicated by said counting value in one of the forth movement and the back movement of said print head, a second test printing pattern control means for moving said print head by generating a test printing pattern to be printed at said predetermined detection position t a position displaced toward a front side or a rear side with a predetermined unit movement amount against said detection position in the other of the forth movement and the back movement of said print head, a printing result selection input means for selecting and inputting a test printing pattern which has a relation of a minimum printing position drift within a relative test printing pattern, said relative test printing pattern is printed by a forth and back direction printing, a printing displacement value detection means for detecting a displacement value of a test printing pattern control in which said selected and inputted test printing pattern is printed, and a printing correction memory means for memorizing a correction value which is obtained under a displacement value detected by said printing displacement value detection means.

7. An input apparatus according to claim 6, wherein said one of said test printing pattern control means further includes a correction means for making said counting value as said predetermined detection position which is memorized in said printing correction value memory means, during the movement of said print head.

8. An input apparatus according to claim 6, wherein said carriage drive motor is a pulse motor, and said print head position detection means has an up-down counter for indicating the position of said print head by counting a pulse signal for driving said pulse motor.

9. An input apparatus according to claim 6, wherein said carriage drive motor includes an encoder for detecting a rotation of said carriage drive motor, and said print head position detection means has an up-down counter for indicating the position of said print head by counting an output pulse of said encoder.

10. An input apparatus in which a print head is moved toward a forth and back movement in a width direction of a printing paper, said printing paper is moved in a lengthwise direction of said printing paper, said print head is moved in accordance with a detection position of said print head, a printing pattern is printed on said printing paper, and a relative printing position drift at a forth passage printing and a back passage printing in a width direction is corrected, wherein said input apparatus includes further a test printing pattern control means for controlling a test printing pattern, during one of a forth passage printing and a back passage printing, said test printing pattern control means carries out the test printing pattern control at a predetermined detection position of said print head, and other of the forth passage printing and the back passage printing, said test printing pattern control means carries out the test printing pattern control at a displaced position in a front side or a rear side with a predetermined movement amount against said predetermined detection position;

a displacement value detection means for detecting a displacement value of a test printing pattern control, said displacement value detection means carries out said test printing pattern control in which a selected test printing pattern drift which has a relation of the minimum printing position drift among relative test printing patterns in a forth and back direction printing;

a correction value memory means for memorizing a detection position correction value which is obtained in accordance with said detected displacement value; and a printing position correction means for correcting and printing a relative relation of a detection position in the forth passage printing and a detection position in the back passage printing in accordance with said memorized correction value.

11. An input apparatus comprising an input means for inputting a character information and a control indication etc., a display means for displaying the character information and the control indication inputted by said input means, a memory means for memorizing eh character information and the control indication inputted by said input means, and a document edition means for carrying out a document edition processing in accordance with the character information and the control indication inputted by said input means and for displaying an edited document in said display means;

a print head mounted on a carriage, a carriage drive motor for driving said carriage toward a forth and back movement in a width direction of a printing paper, a home position detection means for detecting a home position of said print head, said home position for said print head is a standard position of a movement in the width direction of said print head, a print head position detection means for detecting a position with the home position of said print head, a printing pattern memory means for memorizing a printing pattern, said printing pattern is printed using said print head, a print head drive means for controlling a printing of said print head by reading out the printing pattern from said printing pattern memory means in accordance with a position of said print head, said position of said print head is detected from said print head position detection means, a printing paper feed means for feeding said printing paper toward a lengthwise direction of said printing paper, and after a position is corrected with a predetermined amount against a position detection result of said print head, a printing position drift correction control means carries out the printing using said print head, wherein said print head position detection means includes a forth passage position detection means for detecting a present position of said print head in accordance with a counting value by addition-counting successively an electric signal generated every unit movement amount during a forth passage movement of said print head, and a back passage position detection means for detecting a present position of said print head in accordance with a counting value by subtraction-counting successively said electric signal generated every unit movement amount during a back passage movement of said print head;

said printing position drift correction means, in a printing with a printing position drift correction mode, includes a first one-way test printing pattern control means for moving said print head by generating a test printing pattern at a predetermined detection position indicated by said counting value in one of the forth movement and the back movement of said print head, a second one-way printing pattern control means for moving said print head by generating a test printing pattern to be printed at said predetermined detection position at a position displaced toward a front side or a rear side with a predetermined unit movement amount against said detection position in the other hand of the forth movement and the back movement of said print head, a printing result selection input means for selecting and inputting a test printing pattern which has a relation of a minimum printing position drift within a relative test printing pattern by said input means, said relative test printing pattern is printed by a forth and back direction printing, a printing displacement value detection means for detecting a displacement value of a test printing pattern control in which said selected and inputted test printing pattern by said printing result selection input means is printed, and a printing correction memory means for memorizing a correction value which is obtained in accordance with a displacement value detected by said printing displacement value detection means.

12. An input apparatus according to claim 11, wherein said one of said one-way test printing pattern control means further includes a correction means for making said counting value as said predetermined detection position which is memorized in said printing correction value memory means, during the movement of said print head.

* * * * *